US006935761B2

(12) United States Patent
Vanderschuit

(10) Patent No.: US 6,935,761 B2
(45) Date of Patent: Aug. 30, 2005

(54) LIGHTED HAT

(76) Inventor: Carl R. Vanderschuit, 751 Turquoise St., San Diego, CA (US) 92109

( * ) Notice: Subject to any disclaimer, the term of this patent is extended or adjusted under 35 U.S.C. 154(b) by 70 days.

(21) Appl. No.: 10/606,325

(22) Filed: Jun. 25, 2003

(65) Prior Publication Data

US 2004/0264173 A1 Dec. 30, 2004

(51) Int. Cl.[7] ..... F21V 21/084

(52) U.S. Cl. ..... 362/106; 362/231; 362/551; 362/800; 362/806; 362/84

(58) Field of Search ..... 362/103–106, 362/84, 184, 190, 191, 800, 806, 276, 234, 237, 252, 551, 554–556; 2/195.1, 195.2, 209.12; 250/461.1; 40/543

(56) References Cited

U.S. PATENT DOCUMENTS

| | | | | | |
|---|---|---|---|---|---|
| 4,231,079 | A | * | 10/1980 | Heminover | 362/106 |
| 4,570,206 | A | | 2/1986 | Deutsch | |
| 4,901,211 | A | * | 2/1990 | Shen | 362/106 |
| 5,177,812 | A | | 1/1993 | DeMars | |
| 5,404,593 | A | | 4/1995 | Kronenberger | |
| 5,485,358 | A | | 1/1996 | Chien | |
| 5,510,961 | A | * | 4/1996 | Peng | 362/106 |
| 5,647,064 | A | * | 7/1997 | Whittaker | 2/195.5 |
| 5,667,294 | A | | 9/1997 | Lo | |
| 5,676,449 | A | * | 10/1997 | Newsome | 362/106 |
| 5,741,060 | A | | 4/1998 | Johnson | |
| 5,758,947 | A | | 6/1998 | Glatt | |
| 5,809,678 | A | * | 9/1998 | Douglas | 40/542 |
| 5,871,271 | A | | 2/1999 | Chien | |
| 5,921,674 | A | | 7/1999 | Koczi | |
| 5,931,559 | A | * | 8/1999 | Pfaeffle | 362/106 |
| 6,002,079 | A | | 12/1999 | Shin et al. | |
| 6,032,293 | A | | 3/2000 | Makki | |
| 6,044,495 | A | * | 4/2000 | Ellman et al. | 2/195.1 |
| 6,097,287 | A | | 8/2000 | Lu | |
| 6,113,244 | A | | 9/2000 | Baumgartner | |
| 6,116,745 | A | | 9/2000 | Yei | |
| 6,168,286 | B1 | | 1/2001 | Duffy | |
| 6,325,521 | B1 | | 12/2001 | Gregg et al. | |
| D455,539 | S | | 4/2002 | Kates | |
| 6,416,198 | B1 | | 7/2002 | Vanderschuit | |
| 6,499,145 | B1 | | 12/2002 | Kates | |
| 6,659,618 | B2 | * | 12/2003 | Waters | 362/106 |
| 6,721,962 | B1 | * | 4/2004 | Polaire | 2/209.13 |
| 6,733,150 | B1 | * | 5/2004 | Hanley | 362/106 |
| 2003/0026088 | A1 | | 2/2003 | Vanderschuit | |
| 2003/0151910 | A1 | * | 8/2003 | Marston | 362/106 |

FOREIGN PATENT DOCUMENTS

| | | | | | |
|---|---|---|---|---|---|
| CH | 662 931 | A | | 11/1987 | |
| DE | 299 18 185 | U | | 1/2000 | |
| EP | 0 231 471 | A | | 8/1987 | |
| GB | 2 392 973 | A | | 3/2004 | |
| JP | 05151808 | A | * | 6/1993 | F21V/8/00 |
| JP | 2001011716 | A | * | 1/2001 | A41D/27/08 |
| WO | WO 93 18358 | A | | 9/1993 | |

OTHER PUBLICATIONS

U.S. Appl. No. 10/606,314, filed Jun. 25, 2003, entitled Lighted Hat, Applicant Carl R. Vanderschuit, 26 pages specifications, 9 pages drawings.
Pending U.S. Appl. No. 10/341,239, filed Jan. 13, 2003, Vanderschuit, Mood–Enhancing Illumination Apparatus.
Pending U.S. Appl. No. 10/606,324, filed Jun. 25, 2003, Vanderschuit, Lighting Device.

(Continued)

*Primary Examiner*—Stephen Husar
*Assistant Examiner*—Hargobind S. Sawhney
(74) *Attorney, Agent, or Firm*—Harness, Dickey & Pierce P.L.C.; Anthony G. Fussner

(57) ABSTRACT

A lighted hat is provided that in one embodiment includes a crown, a bill extending from the crown, and at least one light source positioned to direct light through a light-transmissive portion of the bill. The light-transmissive portion may include one or more indicia which are highlighted by light from the light source.

11 Claims, 9 Drawing Sheets

OTHER PUBLICATIONS

Pending U.S. Appl. No. 10/606,314, filed Jun. 25, 2003, Vanderschuit, Lighted Hat.
Pending U.S. Appl. No. 10/786,995, filed Feb. 25, 2004, Vanderschuit, Therapeutic Devices and Methods for Applying Therapy.
Pending U.S. Appl. No. 10/797,251, filed Mar. 10, 2004, Vanderschuit, Lighted Balloons.

United Kingdom Combined Search and Examination Report dated Jan. 6, 2004; Application No. GB 0326549.3; 4 pages.

Supplementary European Search Report dated Mar. 1, 2004; App. No. EP 01 93 9305; 3 pages.

* cited by examiner

LIGHTED HAT

FIELD OF THE INVENTION

The present invention relates generally to headwear pieces and more particularly to lighted hats.

BACKGROUND OF THE INVENTION

Hats are available in a wide variety of colors, sizes, shapes, and designs. Despite the great popularity and wide variety of available hats, the inventor has recognized a need for lighted hats that provide stimulating and pleasing visual effects.

SUMMARY OF THE INVENTION

In order to solve these and other needs in the art, the inventor hereof has succeeded at designing a lighted hat. In one exemplary embodiment, the lighted hat includes a crown and a bill extending from the crown. At least one light source is positioned for directing light through at least a portion of the bill.

In another exemplary embodiment, a lighted hat is provided that includes a crown and a bill extending from the crown. The bill includes at least one light-transmissive portion. At least one light source is positioned within the bill for directing light through the light-transmissive portion.

In another exemplary embodiment, a lighted hat is provided that includes a crown and a bill extending from the crown. The bill includes at least one light transmissive portion, which defines one or more indicia. The hat further includes at least one light source for directing light-through the light-transmissive portion to highlight the indicia.

In another exemplary embodiment, a lighted headwear piece is provided that includes a head attachment portion and a bill extending from the head attachment portion. At least a portion of the bill is responsive to black light. The headwear piece further includes at least one light source for directing black light at the black light-responsive portion of the bill.

In another exemplary embodiment, a lighted headwear piece is provided that includes a head attachment portion and a bill extending from the head attachment portion. The lighted headwear piece further includes a chemiluminescent material positioned adjacent an edge portion of the bill to illuminate the edge portion.

In another exemplary embodiment, a lighted headwear piece is provided that includes a head attachment portion and a bill extending from the head attachment portion. At least one light source is positioned for directing light through at least a portion of the bill.

In another exemplary embodiment, a device for illuminating an edge portion of a bill of a headwear piece is provided. The device includes a flexible tubular member adapted to be positioned along the edge portion of the bill. The flexible tubular member includes a light-transmissive portion. At least one light source is coupled to the flexible tubular member. The light source directs light through the light-transmissive portion.

In another exemplary embodiment, a headwear piece is provided that includes a head attachment portion and a bill extending from the head attachment portion. A display device is positioned on at least one of the head attachment portion and the bill. One or more indicia are displayed by the display device. A controller controls the operation of the display device.

In another form, the present invention provides a method that in one embodiment generally comprises: transmitting a signal to at least one lighted headwear piece from a source external to the lighted headwear piece; receiving the signal at the lighted headwear piece; and controlling the operation of at least one light source coupled to the lighted headwear piece in accordance with the signal.

Further areas of applicability of the present invention will become apparent from the detailed description provided hereinafter. It should be understood that the detailed description and specific examples below, while indicating exemplary embodiments of the invention, are intended for purposes of illustration only and are not intended to limit the scope of the invention.

BRIEF DESCRIPTION OF THE DRAWINGS

The present invention will be more fully understood from the detailed description and the accompanying drawings, wherein.

Corresponding reference characters indicate corresponding features throughout the drawings.

DETAILED DESCRIPTION OF EXEMPLARY EMBODIMENTS

Figure 1:
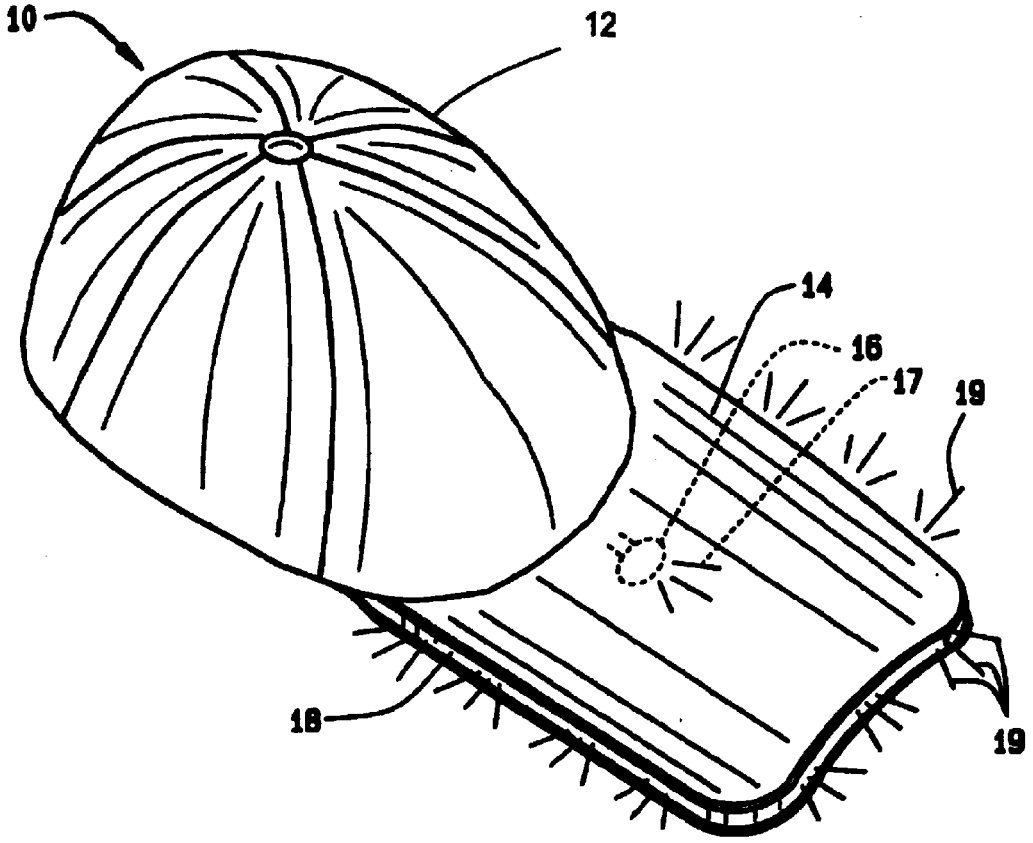
FIG. 1 is a perspective view of a lighted hat according to one exemplary embodiment of the present invention.

A lighted hat according to one embodiment of the invention is indicated generally in FIG. 1 by reference number 10. As shown, the lighted hat 10 includes a crown 12 and a bill 14 extending outwardly from the crown 12. The bill 14 includes an edge portion 18. The hat 10 is provided with at least one light source 16 (shown within the bill 14 in phantom) for directing light 17 through the edge portion 18. This, in turn, illuminates (represented by light rays 19) the edge portion 18 thus providing a pleasing appearance, which may then draw attention to the hat 10 and the user wearing the hat 10.

The crown 12 and the bill 14 may be formed from a wide range of materials. In one exemplary embodiment, the crown 12 and the bill 14 are both made from a fabric material, such as nylon, cotton, canvas, felt, corduroy, etc. In addition, the fabric material forming the bill 14 may be reinforced with an inner cardboard or plastic stiffener.

Figure 3:
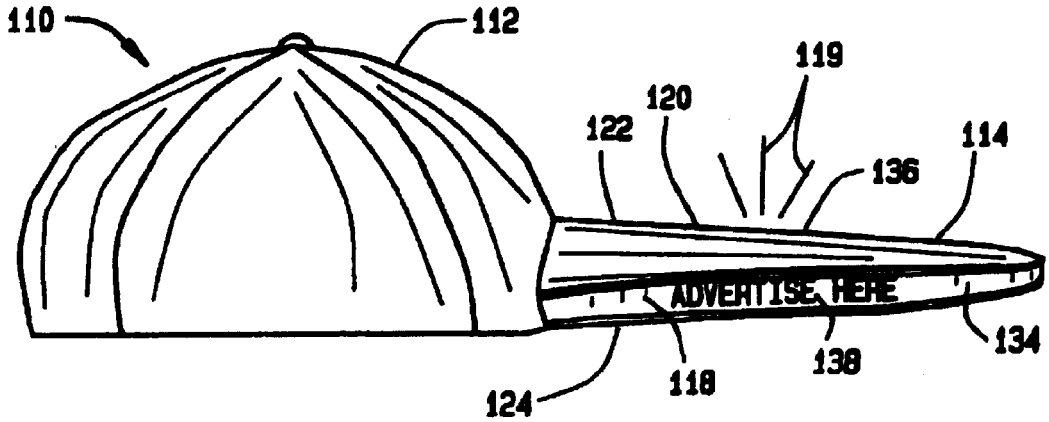
FIG. 3 is a side view of the lighted hat shown in FIG. 2.
Figure 2:
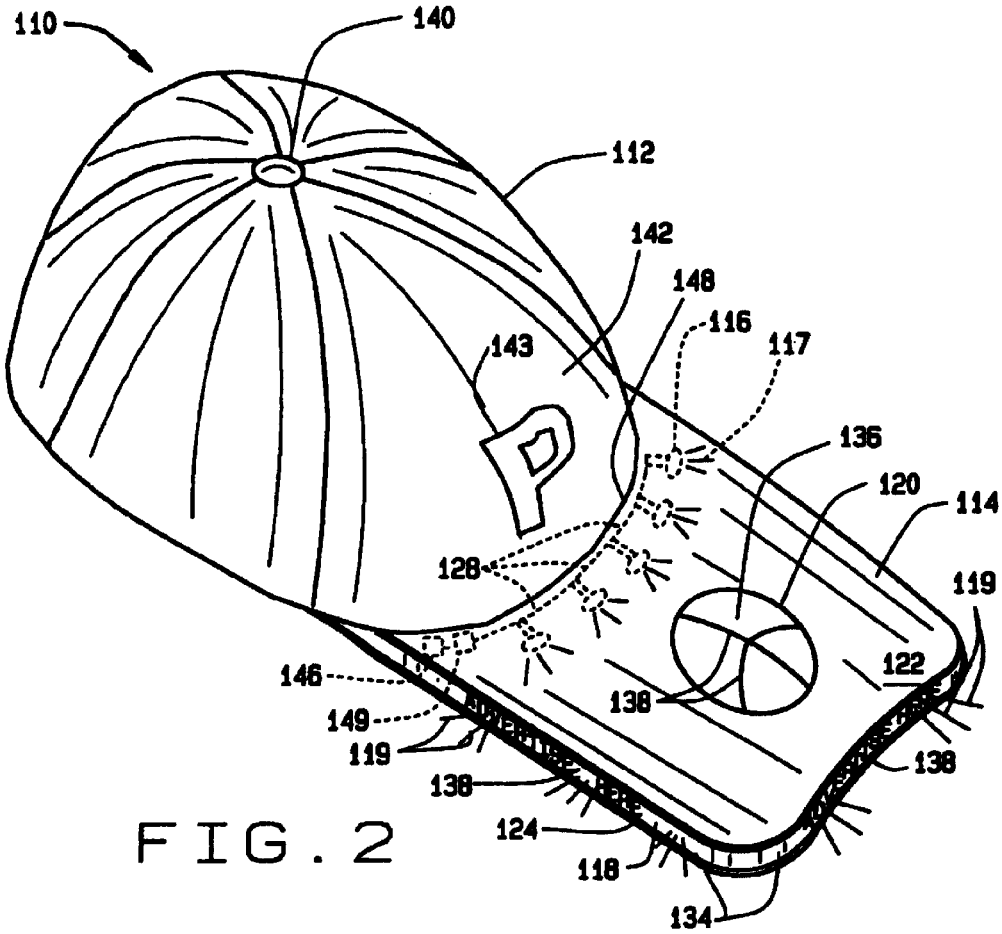
FIG. 2 is a perspective view of a lighted hat according to another exemplary embodiment of the present invention.
Figure 4:
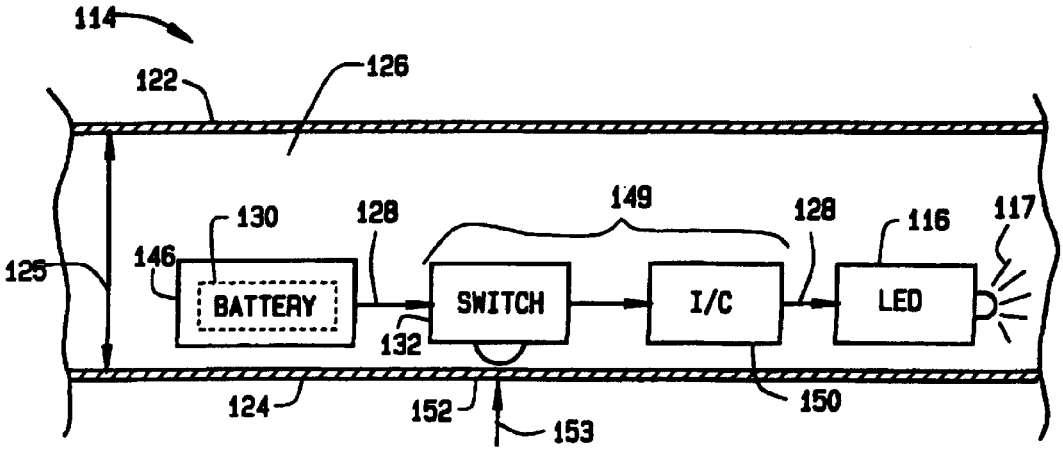
FIG. 4 is a partial cross-sectional view of the bill of the lighted hat of FIG. 2.

FIGS. 2 through 4 illustrate a lighted hat 110 in accordance with another embodiment of the invention. As shown in FIG. 2, the lighted, hat 110 includes a crown 112 and bill 114 extending outwardly from the crown 112. The hat 110 is provided with a plurality of light sources 116 (shown in phantom) for directing light 117 through an edge portion 118 and/or an upper portion 120 of the bill 114. This, in turn, illuminates the edge portion 118 and/or the upper portion 120 providing a pleasing appearance, which may then draw attention to the hat 110 and its wearer.

As shown in FIG. 4, the bill 114 includes upper and lower layers 122 and 124 separated by a spaced distance 125 to define a cavity 126. The cavity 126 is sized to receive conductive leads or wiring 128 and the light sources 116. The conductive leads 128 interconnect the light sources 116 to a power source 130 and a switch 132, all of which may also be positioned within the cavity 126 of the bill 114 as shown.

With further reference to FIG. 2, the hat 110 further include a first light-transmissive portion 134 that is positioned adjacent and along the edge portion 118 of the bill 114. The first light-transmissive portion 134 is also positioned between the upper and lower layers 122 and 124 of the bill 114. The hat 110 also includes a second light-transmissive portion 136 on the upper portion 120 of the bill 114.

Either or both of the light-transmissive portions 134 and 136 may include apertures or materials having a higher light transmissibility than the portions of the bill 114 surrounding the light-transmissive portions 134 and 136. The light-transmissive portions 134 and 136 allow at least a portion of the light 117 from the light sources 116 to pass therethrough, thus becoming-externally visible. To increase the amount of light 117 that passes through the light-transmissive portions 134 and 136 and thus enhance the illumination effect, the upper and lower layers 122 and 124 of the bill 114 may be substantially opaque or reflective.

A wide range of materials may be used for the light-transmissive portions 134 and 136, such as transparent, translucent, and other light-altering materials (i.e., materials that alter light by refraction, diffraction, diffusion, and/or dispersion). The type of material used for the light-transmissive portions 134 and 136 may depend at least in part on the particular type and intensity of the light produced by the light sources 116.

In one embodiment, the first and second light-transmissive portions 134 and 136 are formed from a flexible soft vinyl or plastic that is transparent and/or translucent. In other embodiments, either or both of the light-transmissive portions 134 and 136 may be formed from a fabric material that has a higher light transmissibility (i.e., allows more light to pass therethrough) than the portions of the bill 114 surrounding the light-transmissive portions 134 and 136.

The lighted hat 110 may also include one or more indicia 138 (e.g., alphanumeric characters, logos, designs, advertisements, trademarks, sports team insignia, etc.) which are highlighted (e.g., illuminated) by the light 117 from the light sources 116. In the illustrated embodiment of FIG. 2, the first light-transmissive portion 134 includes a translucent plastic material provided (e.g., etched) with the indicia "ADVERTISE HERE", which is highlighted by the projection 119 of the light 117 therethrough. Alternatively, the hat 110 can include one or more indicia which are light-blocking such that the indicia contrasts with the background portion of the first light-transmissive portion 134 through which the light 117 passes.

With further reference to FIG. 2, the second light-transmissive portion 136 is formed from a translucent plastic material that is configured in the shape of one or more indicia 138, which in the illustrated embodiment is a peace sign. Alternatively, other shapes can be used for the second light-transmissive portion 136 such as sports team insignia, alphanumeric characters, logos, etc.

In another exemplary embodiment, the one or more indicia of either or both of light-transmissive portions 134 and 136 may be defined by a material that is reactive or responsive to black light, which may be produced by the light sources 116. Exemplary materials that are responsive to black light include plastic materials containing phosphor (e.g., Zinc Sulfide, Strontium Aluminate) and fluorescent materials.

In another exemplary embodiment, the light transmissive portions 134 and/or 136 is formed of a fine mesh material, such as silk. The light-transmissive portions 134 and/or 136 are provided with one or more indicia by using a known silk-screening process.

Optionally, the crown 112 may also include one or more light-transmissive portions through which light from one or more of the light sources 116 is directed. For example, the top 140 and front portion 142 of the crown 112 may include respective light-transmissive portions, (e.g., 143) through which is directed light from one or more light sources within the crown 112. In at least some embodiments, portions of the crown 112 are defined by a material that is reactive or responsive to black light, which may be produced by one or more light sources within the crown 112 and/or within the bill 114.

The lighted hat 110 also includes a power source compartment 146 within the bill 114. The power source compartment 146 is adapted to receive the power source 130 therein. The power source compartment 146, however, can also reside elsewhere. For example, the power source compartment 146 may reside within the crown 112 or be attached to an adjustable or elastic strap used for adjusting the hat size to the user. Or for example, the power source compartment 146 may be attached to the user's clothing. (e.g., belt, shirt, etc.) or be positioned at another location remote or external to the hat 110.

In the illustrated embodiment of FIG. 4, the power source 130 is a battery, such as a three-volt lithium watch battery. However, it should be noted that the power source 130 may be any suitable means of providing energy to the light sources 116 including renewable batteries, rechargeable batteries, disposable batteries, solar cells positioned on a top portion of the bill and/or the crown, and other suitable power sources.

To allow a user internal access to the power source compartment 146, for example, to install, replace, or remove batteries, the power source container 146 may include a removable portion. The removable portion may be engaged with the power source compartment 146 using a suitable fastening system or method (e.g., a threaded connection, an interference fit, resilient ribs, among others).

The light sources 116 will now be described in more detail. In the illustrated embodiment of FIG. 2, the light sources 116 include five (5) LEDs, however, other quantities of LEDs may also be employed. In addition, any suitable light source may be employed including incandescent, laser, fluorescent, phosphorescent, chemiluminescent, halogen, fiber optics, electroluminescent, neon light sources, and the like.

Optionally, one or more of the various LEDs 116 may produce light that has at least one attribute (e.g., color, intensity, blink speed, hue, saturation, brightness, etc.) different than the light produced by the other LEDs 116. By way of example, one or more LEDs 116 may produce blue-colored light, whereas the other LEDs 116 may produce red-colored light. Rather than producing colored light, one or more of the LEDs 116 could produce broadband light that travels through a colored filter, which may but need not be one of the light-transmissive portions 134 and 136.

Indeed, the various lighted headwear pieces (e.g., 10, 110, 210, 310, 410, 510) of the present invention can be configured to produce any of a wide range of colored light depending at least in part on user preferences. User preferences may in turn be based on any number of factors including the color of the clothes the user is wearing and/or the type of event (e.g., dance, sporting event, etc.) the user will attend while wearing the lighted headwear piece. For example, the user may prefer a lighted hat that produces colored light consistent with the home team's colors when attending a sporting event, such as a football game.

As shown in FIG. 2, each LED 116 is positioned within the cavity 126 of the bill 114. The LEDs 116 are oriented to direct light 117 through the light-transmissive portions 134 and 136, which in the illustrated embodiment are translucent and thus light-altering. The light-transmissive portions 134 and 136 receive and alter the light 117 from the LEDs 116 to illuminate 119 the edge portion 118 and/or upper portion 120 of the bill 114. Alternatively, each LED 116 need not be positioned entirely within the cavity 126 of the bill 114. Instead, one or more of the LEDs 116 may be partially or entirely positioned external to the bill 114, for example, on the upper bill layer 122 and/or in the crown 112.

The LEDs 116 are shown positioned adjacent and along the portion 148 of the bill 114 that is attached to the crown 112. Additionally, or alternatively, the LEDs may be positioned adjacent and along the edge portion 218 of the bill 214 as shown in the embodiment 210 of FIG. 5. In another embodiment 310 shown in FIG. 6, LEDs 316 are positioned at about a center of the bill 314. The LEDs 316 are arranged in a substantially u-shaped pattern, although other patterns (e.g., circular, rectangular, etc.) can be used.

Referring back to FIGS. 2 through 4, the various LEDs 116 are interconnected to the power source 130 by the conductive leads 128. The conductive leads 128 are shown positioned within the bill cavity 126.

The operation of the various LEDs 116 may be controlled by a controller 149 in accordance with user input to provide such features as blinking, strobing and/or color changes. As shown in FIG. 4, the controller 149 includes an integrated circuit/printed circuit assembly 150 (i.e., integrated circuits in a printed circuit assembly) and at least one switch 132. The switch 132 may, for example, allow the user to select from among various display modes for the LEDs 116. Such display modes may include an off-light mode, an on-light mode, a mode in which each of the LEDs 116 simultaneously emit steady or non-flashing light, a mode, in which the LEDs 116 emit light intermittently, a mode in which the various LEDs 116 illuminate or blink at different times in accordance with a predetermined sequence or order, a mode in which the various LEDs 116 emit light that phases between or blends colors, a mode in which the LEDs 116 emit light randomly, and/or a mode in which the LEDs 116 pulsate to sounds. The sounds may be produced by the hat 110 itself (e.g., via a speaker built-in to the hat 110) or a source external to the hat 110 (e.g., ambient sounds). In some embodiments, sounds can cause synchronized pulsation of the LEDs 116 of two or more different hats 110, thus providing a pleasing light pattern or effect.

The controller 149 can also include a plurality of switches each of which is used to control the operation of an individual or group of LEDs. For example, the controller 149 may include a first switch for activating and deactivating the LEDs that emit white-colored light, and a second switch for activating and deactivating the LEDs that emit blue-colored light.

In the illustrated embodiment, the controller 149 includes a push-button switch 132 for switchably connecting the light sources 116 to the power source 130. The switch 132 is positioned within the bill 114 and is coupled to an externally flexible surface portion 152 of the bill 114 such that application of external pressure, indicated by arrow 153, upon the externally flexible surface portion 152 activates the switch 132 thereby causing operation of the light source 116. The external pressure 153 may, for example, be applied by the user squeezing the bill 114 at the externally flexible surface portion 152. The switch 132 may also allow the user to cycle through the various display modes or select a particular color for the light sources 116 by successively squeezing the bill 114 at about the externally flexible surface portion 152. Additionally, the switch 132 may also allow the user to dim or brighten the intensity of the light, for example, by holding down the switch 132 with continuously applied pressure to the bill 114 at about the externally flexible surface portion 152.

Alternatively, the switch 132 may include one or more other suitable switch means including motion-responsive switches, light-sensitive switches and compression switches. For example, the switch 132 may be a light-sensitive switch such that the LEDs 116 are activated when the ambient light level falls below a predetermined threshold.

Figure 5:
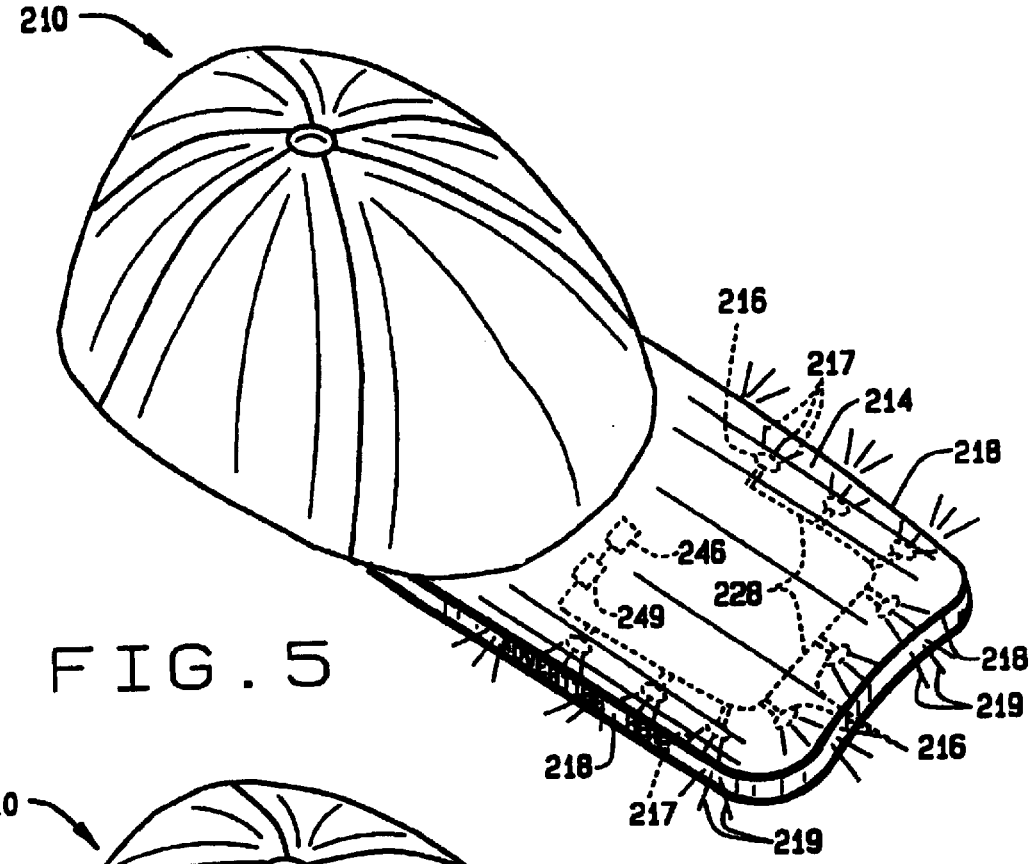
FIG. 5 is a perspective view of a lighted hat according to another exemplary embodiment of the present invention.

FIG. 5 illustrates one exemplary embodiment of a lighted hat 210 wherein the light 217 from the light sources 216 only illuminate 219 the edge portion 218 of the bill 214. Unlike the embodiment 110 shown in FIG. 2 in which the upper portion 120 of the bill 114 was also illuminated, the light sources 216 do not illuminate any other portions of the bill 214. In FIG. 5, the light sources 216 are positioned within the bill 214 adjacent and along the edge portion 218 of the bill 214. The conductive leads 228, power source compartment 246, and controller 249 are also shown positioned within the bill 214.

Figure 6:
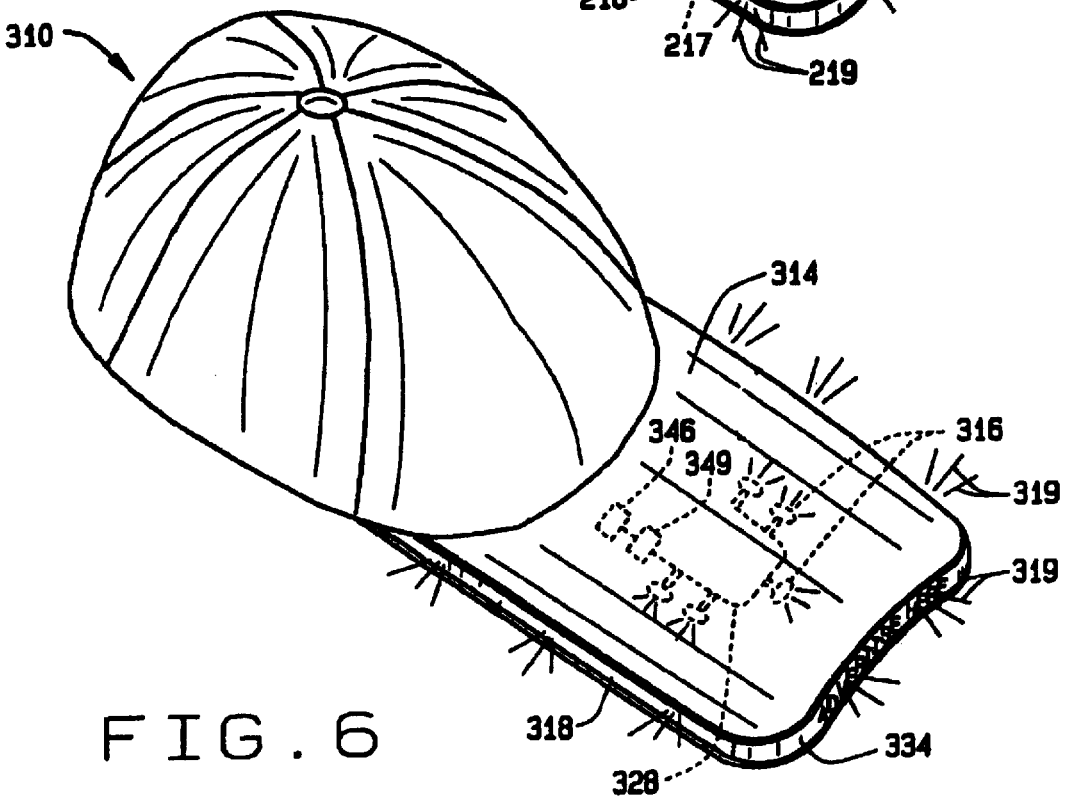
FIG. 6 is a perspective view of a lighted hat according to another exemplary embodiment of the present invention.

In FIG. 6, there is shown a lighted hat 310 wherein the light sources 316 are positioned within the bill 314 at about a center of the bill 314 in a substantially u-shaped pattern to illuminate 319 the edge portion 318. Alternatively, other patterns (e.g., circular, rectangular, etc.) can be used for the light sources 316. The conductive leads 328, power source compartment 346, and controller 349 are also shown positioned within the bill 314.

Figure 7:
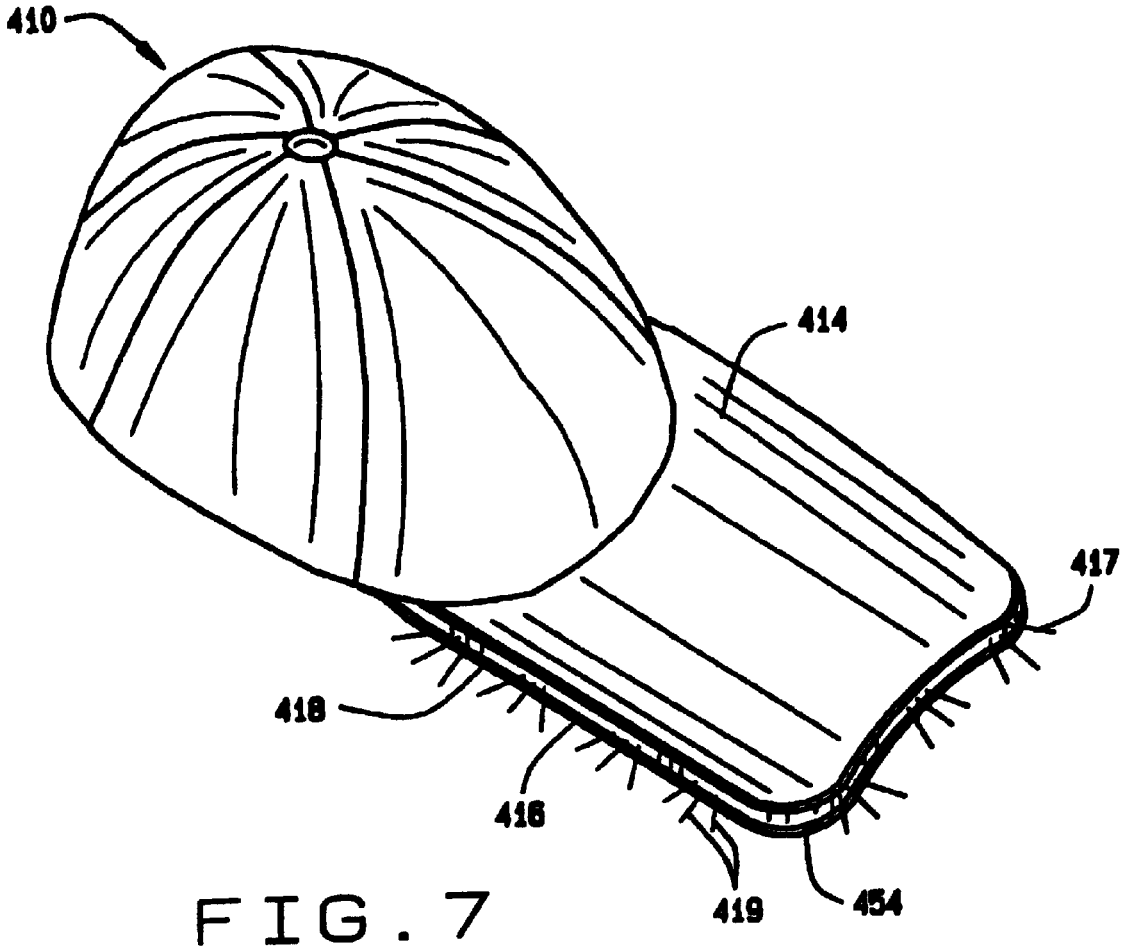
FIG. 7 is a perspective view of a lighted hat according to another exemplary embodiment of the present invention.

FIG. 7 illustrates another exemplary embodiment of a lighted hat 410 wherein the light source 416 is a chemiluminescent material positioned along the edge 418 of the bill 414 to illuminate 419 the edge portion 418. In one embodiment, the light source 416 is a flexible glow or light stick that employs chemiluminescence to produce light 417 from a chemical reaction.

The hat 410 may also be provided with one or more indicia (e.g., alphanumeric characters, logos, designs, advertisements, trademarks, sports team insignia, etc.) which are highlighted by the light 417 from the chemiluminescent light source 416. For example, one embodiment may include one or more indicia that are defined on an external surface 454 of the light source 416 such that the indicia are highlighted by the light 417.

Figure 8:
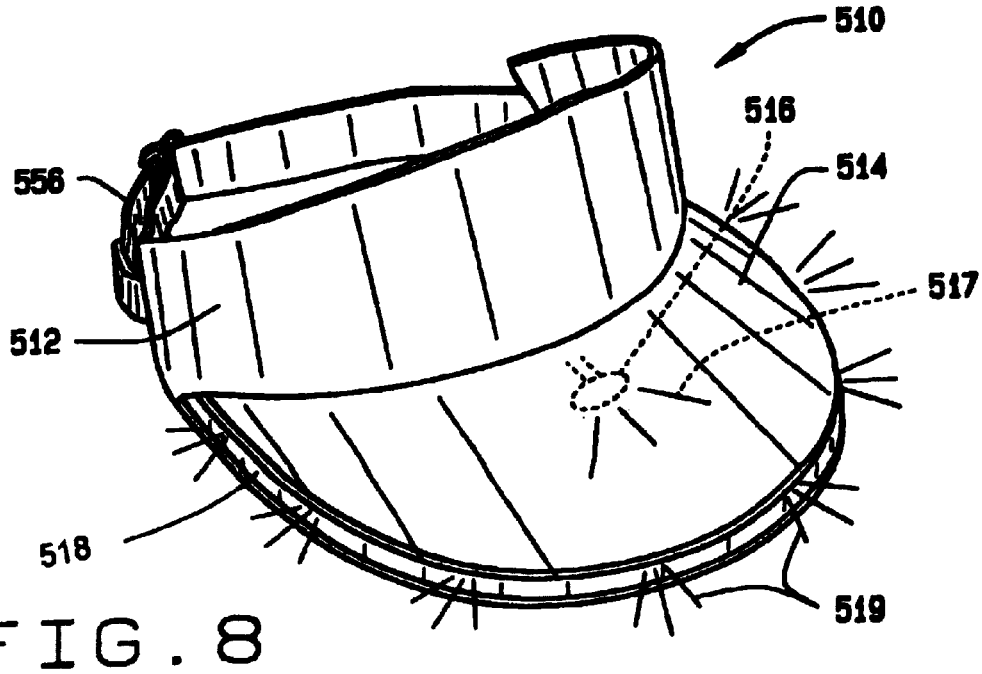
FIG. 8 is a perspective view of a lighted visor according to another exemplary embodiment of the present invention.

FIG. 8 illustrates another embodiment of the invention in which a lighted visor 510 is provided. As shown, the lighted visor 510 includes a head attachment portion 512 and a bill 514 includes an edge portion 518. The lighted visor 510 is provided with at least one light source 516 (shown within the bill 514 in phantom) for directing light 517 through the edge portion 518. This, in turn, illuminates 519 the edge portion 518 of the bill 514.

The head attachment portion 510 may include any of a wide range of head attachment devices 556 including elastic straps, adjustable straps, hook and loop closures, clasps, among other devices.

Figure 9:
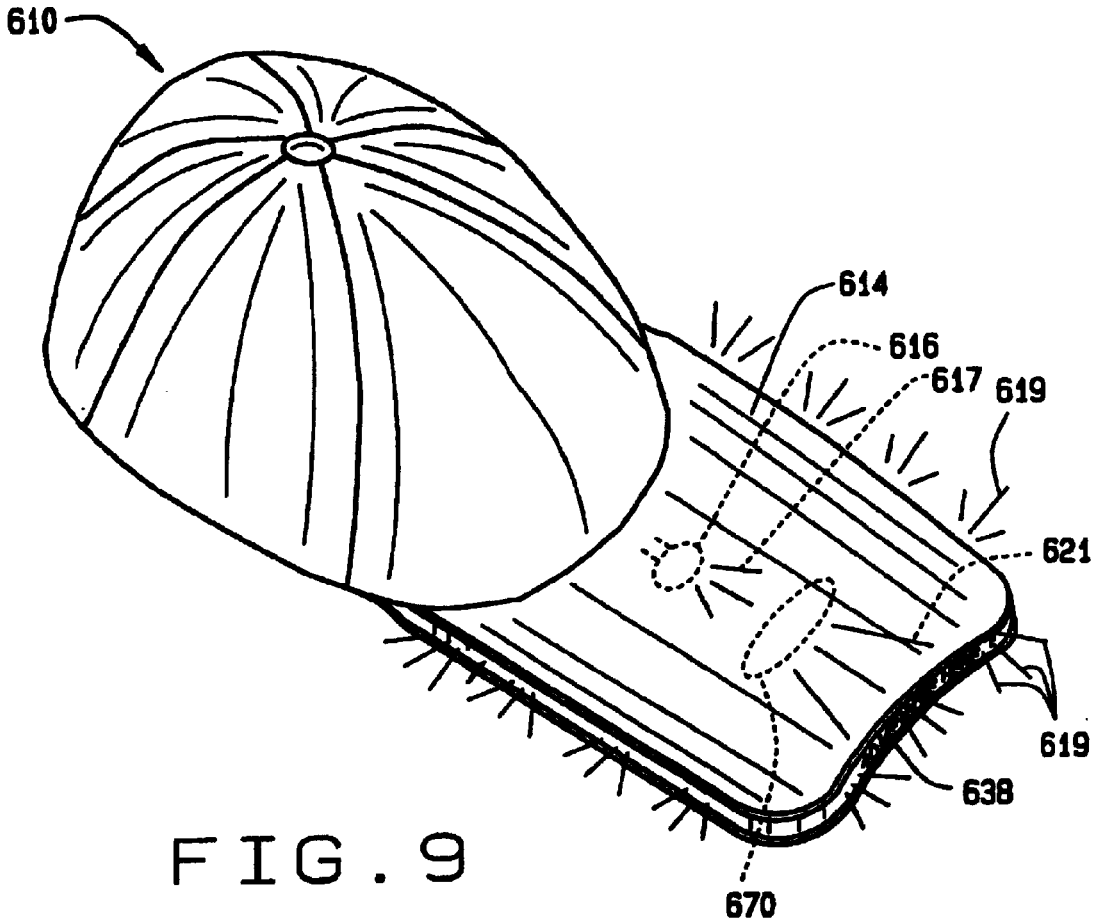
FIG. 9 is perspective view of a lighted hat according to another exemplary embodiment of the present invention.

In FIG. 9, there is shown a lighted hat 610 that includes at least one light source 616 positioned within and at about a center of the bill 614. As shown, the lighted hat 610 includes a light-focusing element or lens 670. The lens 670 is positioned to focus the light 617 emitted by the light source 616 to enhance the illumination effect provided by the light 619 (the focused light is represented by light rays 621). For example, the lens 670 may be positioned within the bill 614 adjacent the light source 616 such that the lens 670 focuses light 621 onto the indicia 638.

Figure 10A:
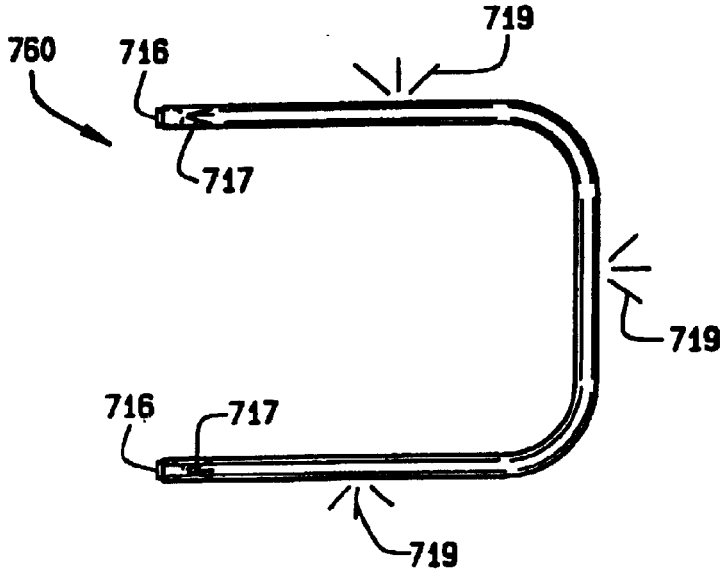
FIG. 10A is a perspective view of a device for illuminating an edge portion of a bill of a headwear piece according to another exemplary embodiment of the present invention.
Figure 10B:
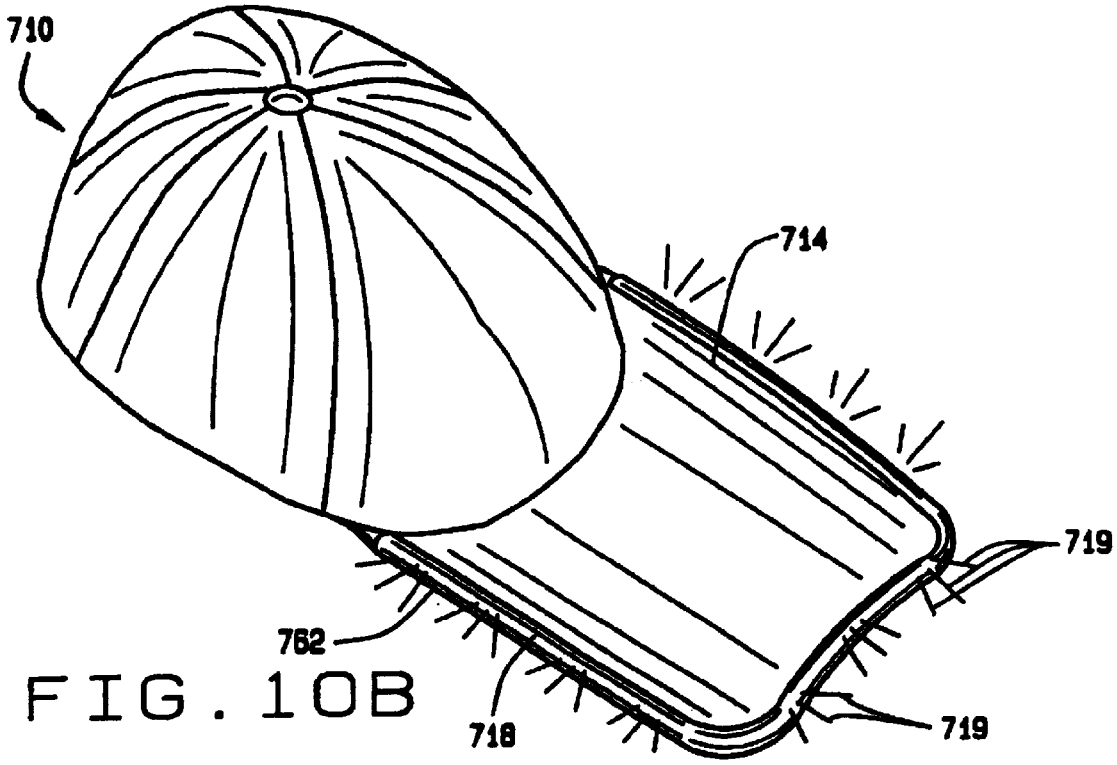
FIG. 10B is a perspective view of the device shown in FIG. 10A provided on a hat.

FIG. 10A illustrates another embodiment of the invention in which a device 760 for illuminating an edge portion of a bill of a headwear piece is provided. FIG. 10B illustrates the device 760 positioned along an edge portion 718 of a bill 714 of a hat 710.

The device 760 includes a flexible tubular member 762 and at least one light source 716 coupled to the flexible tubular member 762 to direct light 717 through the tubular member 762. In the particular illustrated embodiment, the light source 716 includes an LED positioned at each end of the tubular member 762. Additionally, or alternatively, the light source may include one or more LEDs embedded within the tubular member along the length of the tubular member.

Each light source 716 is coupled to a power source. The power source may be positioned within the flexible tubular member 762. Alternatively, the power source may be positioned at a location remote or external to the tubular member 762. For example, the power source may be positioned within the bill 714. Or for example, the power source may be attached under the bill 714 of the hat 710 via an adhesive, hook and loop fasteners, or other suitable attachment means.

To allow at least a portion of the light 717 from the LEDs 716 to become externally visible 719, the tubular member 762 may be substantially entirely light-transmissive or include at least a portion which is light-transmissive. The LEDs 716 are oriented to direct light 717 through the light-transmissive portions, which in the illustrated embodiment are translucent and thus light-altering.

As shown in FIG. 10B, the tubular member 762 is sized and adapted to be attached to the hat 710 along the edge portion 718 of the bill 714. In one exemplary embodiment, the tubular member 762 includes a longitudinal slit sized to frictionally receive therein the edge portion 718 of the bill 714. The tubular member 762 is thus attached to the bill 714 via an interference fit. Alternatively, the device 760 may include other suitable fastening means (e.g., clips, clamps, etc,) that allow the device 760 to be fastened to the bill of a wide range of headwear pieces, to thereby provide the headwear piece with a lighted bill edge portion.

Figure 11A:
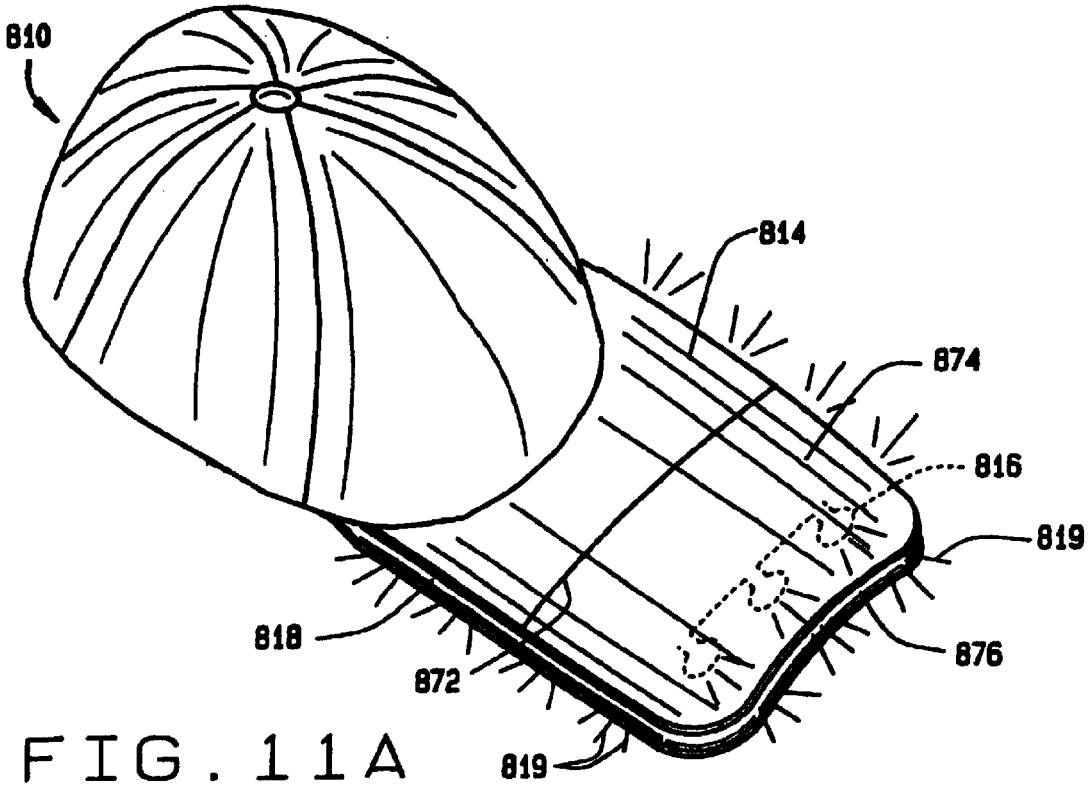
FIGS. 11A, 11B and 11C are perspective views of a lighted hat according to another exemplary embodiment of the present invention.
Figure 11B:
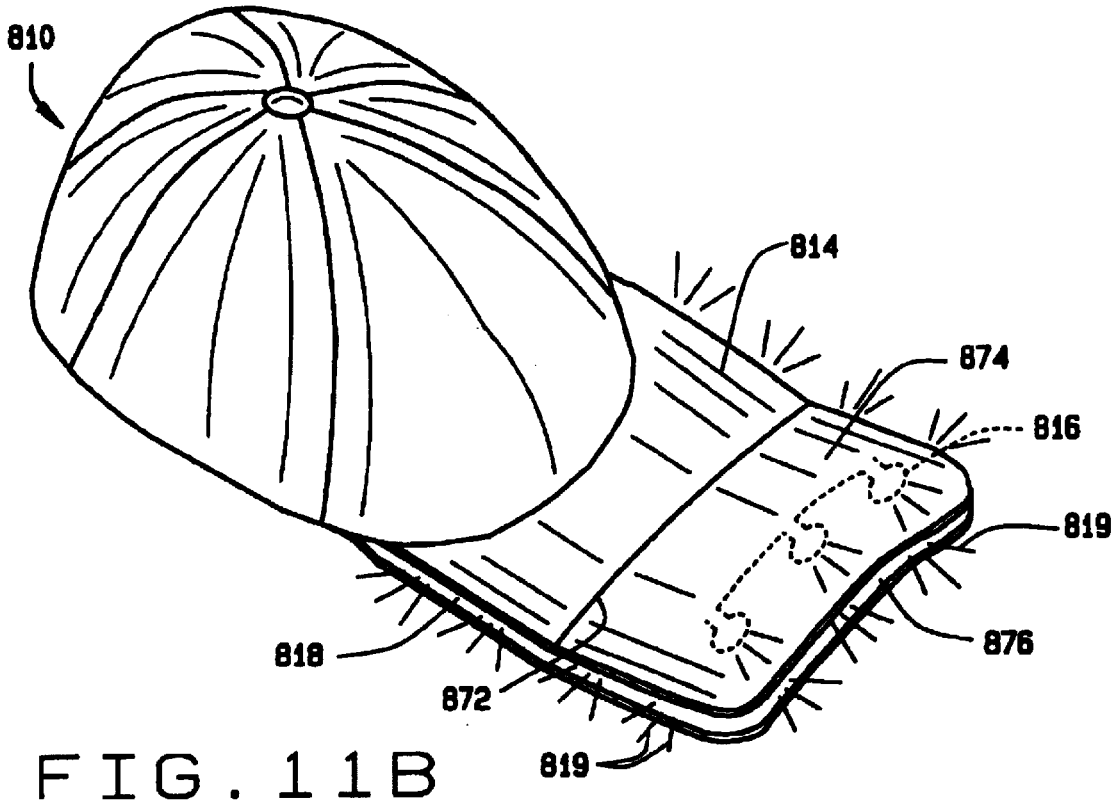
Figure 11C:
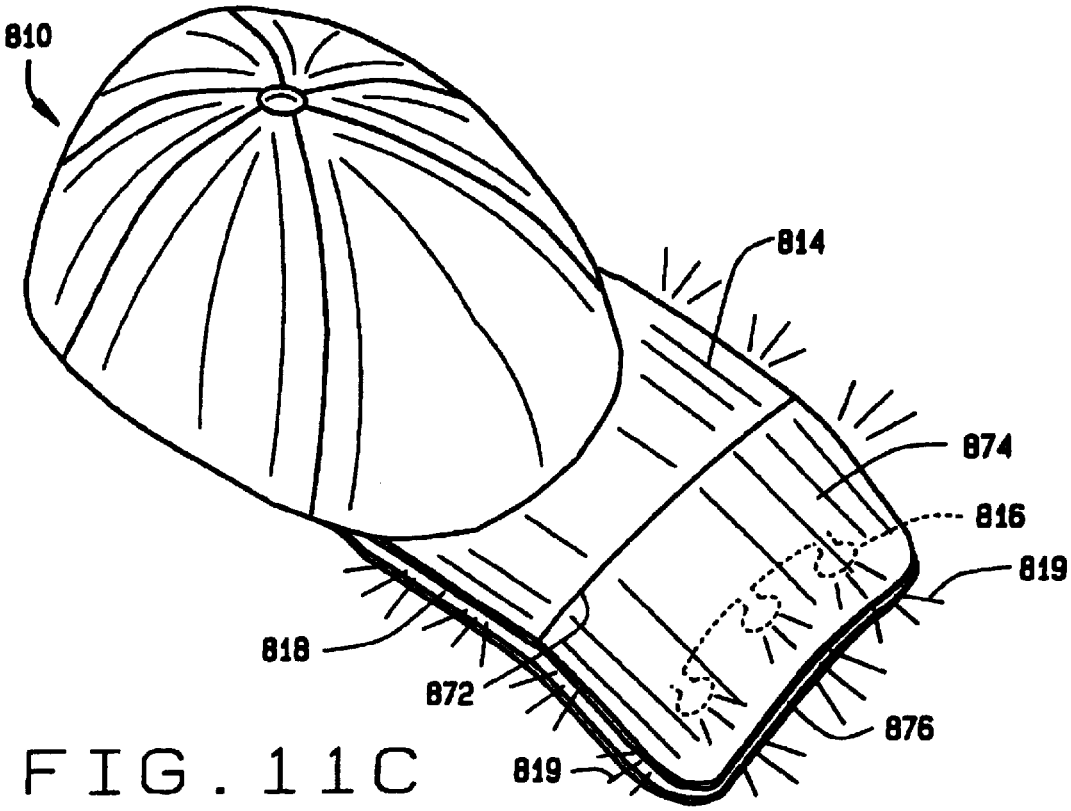

In FIG. 11, there is shown a lighted hat 810 that includes a bill 814 adapted to allow adjustment of the direction of the light emitted by the lighted hat 810. As shown, at least a portion of the bill 814 is pivotable upwardly and/or downwardly about an axis 872. This, in turn, allows a user to adjust the direction of the light 819 being emitted outwardly from the edge portion 818.

The lighted hat 810 includes a plurality of light sources 816 positioned adjacent and along the edge portion 818 of the bill 814. A front portion 874 of the bill 814 can be pivoted upwardly (FIG. 11B) and/or downwardly (FIG. 11C) about the axis 872. This, in turn, allows the front edge portion 876 and thus the direction of the light 819 being transmitted outward through the front edge portion 876 to be adjusted upwardly or downwardly.

FIG. 12 illustrates a lighted hat 910 that includes a bill 914 adapted to allow adjustment of the direction of the light 917 emitted by the light source 916. As shown, at least a portion 915 of the bill 914 and the light source 916 coupled thereto can be pivoted downwardly relative to the remainder of the bill 914. Additionally, or alternatively, the bill portion 915 and the light source 916 coupled thereto can also be pivotable upwardly relative to the remainder of the bill 914.

Figure 12A:
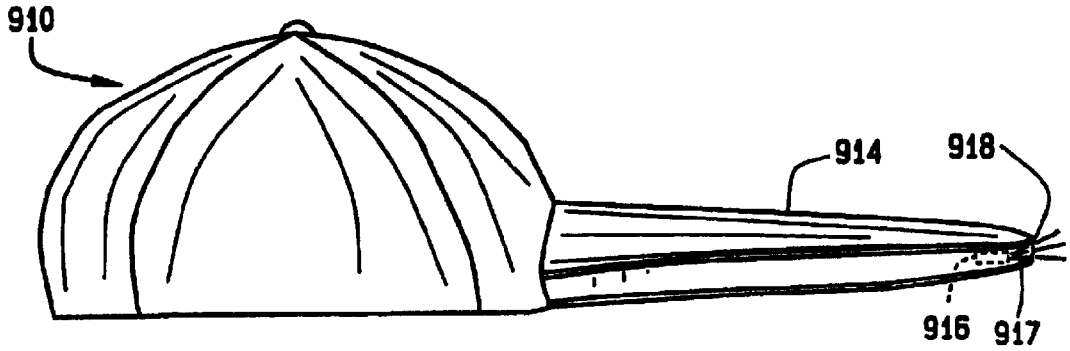
FIGS. 12A and 12B are side views of a lighted hat according to another exemplary embodiment of the present invention.
Figure 12B:
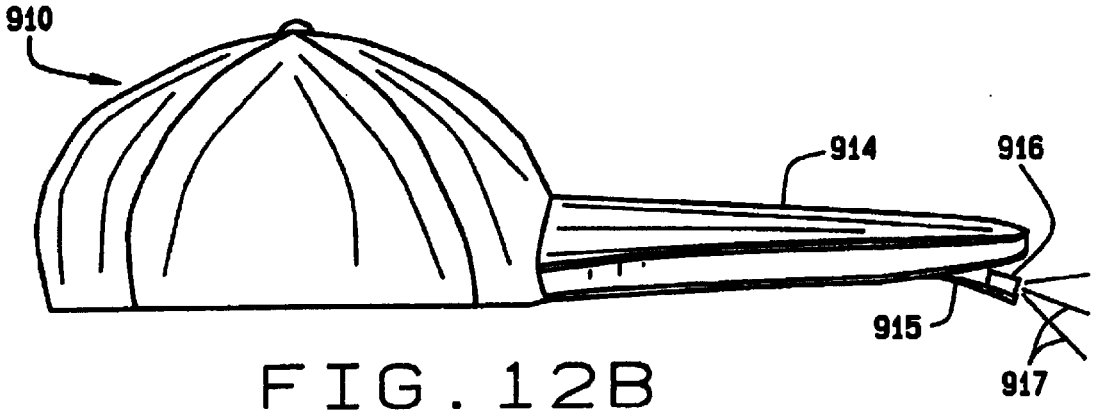
Figure 13:
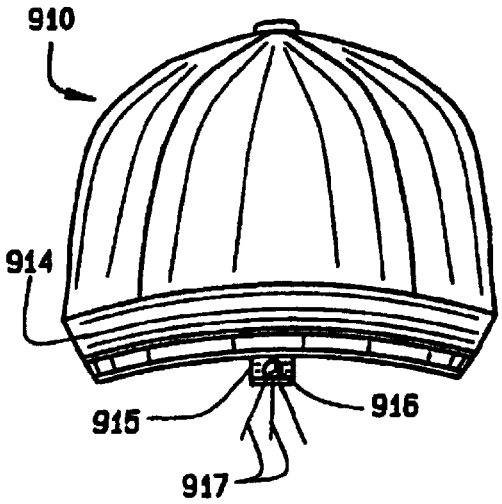
FIG. 13 is a front view of the lighted hat of FIG. 12B.
Figure 14:
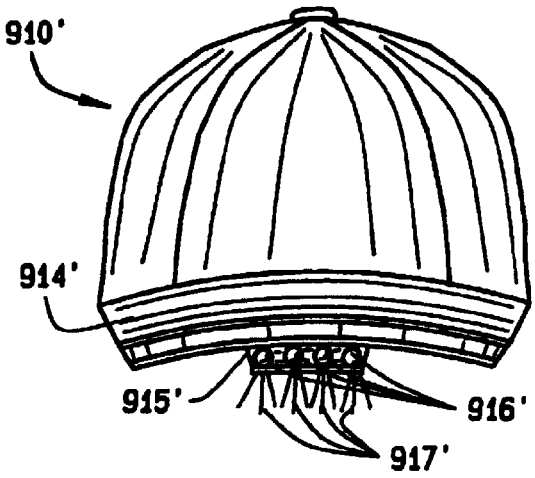
FIG. 14 is a front view of a lighted hat according to another exemplary embodiment of the present invention.

In FIG. 12A, the moveable bill portion 915 is shown in a retracted position in which the light source 916 is positioned within the bill 914 such that the light 917 from the light source 916 is transmitted through the edge portion 918. In the retracted position, the moveable bill portion 915 forms a smooth, continuous lower surface portion of the bill 914, which is contiguous with the lower surface of remainder of the bill 914. FIGS. 12B and 13 show the moveable bill portion 915 in an extended position after the bill portion 915 has been pivoted downwardly from the position shown in FIG. 12A. Pivoting the bill portion 915 adjusts the direction of the light 917 being emitted by the light source 916 in a corresponding upwardly or downwardly direction. The lighted hat 910' may also include a plurality of light sources 916' as shown in FIG. 14.

Figure 15:
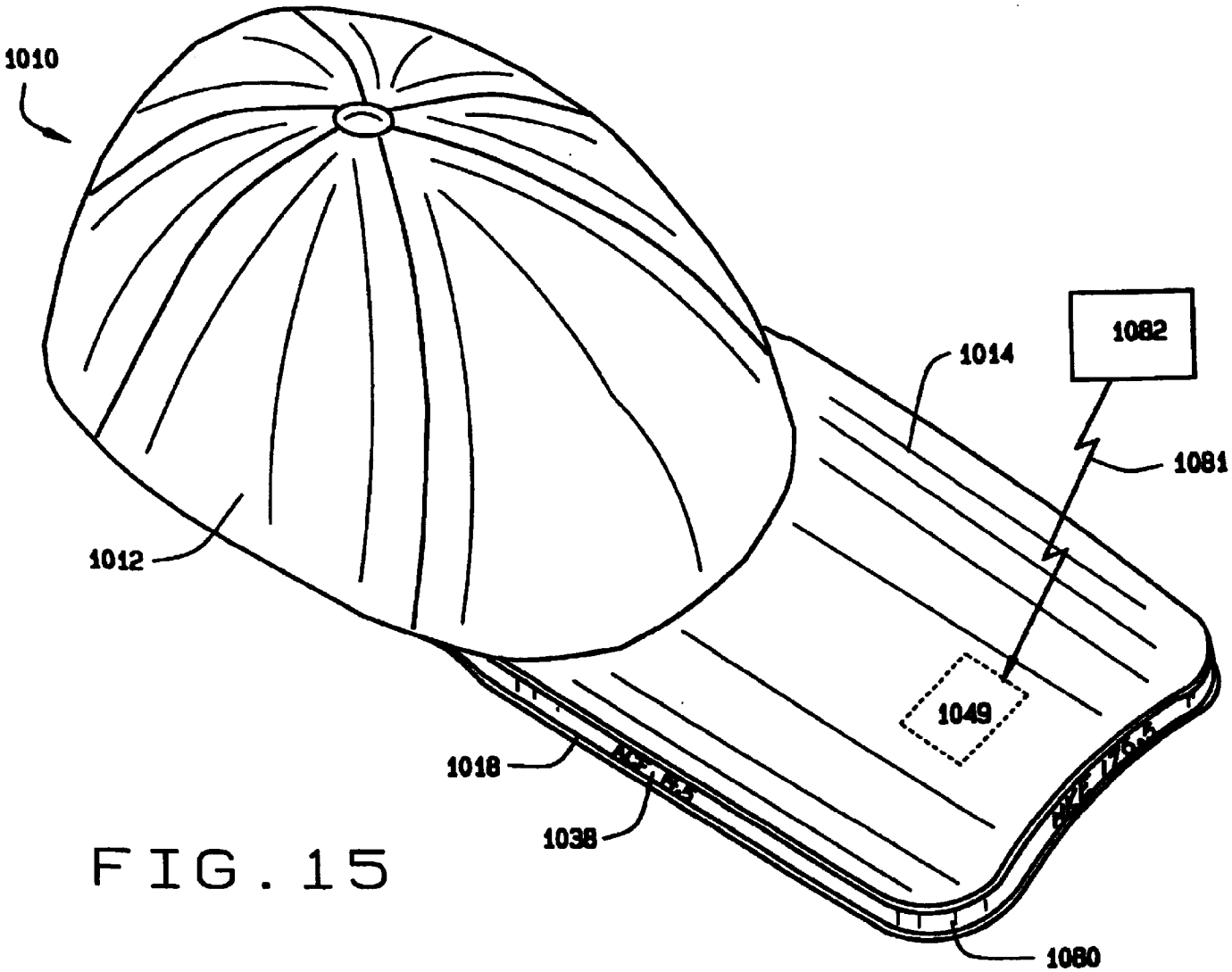
FIG. 15 is a perspective view of a lighted hat according to another exemplary embodiment of the present invention.

In FIG. 15, there is shown a hat 1010 that includes indicia 1038 displayed via a suitable display device 1080 (e.g., an LED, LCD or plasma display device, etc.) positioned on the bill 1014 and/or the crown 1012. The indicia 1038 may be displayed in a flashing, steady, or scrolling fashion. For example, the display device 1080 may display a scrolling stock ticker in which the indicia 1038 are real-time stock quotes which scroll across the edge portion 1018 of the bill 1014. In such embodiments, the display device 1080 may be operatively associated with a controller 1049 (e.g., integrated circuits in a printed circuit assembly within the bill 1014) that receives signals 1081 (wirelessly) from an external source 1082 (e.g., wireless signals communicated between antennae, electromagnetic wave energy, cellular phone, RF energy or radio transmissions, etc.). The signals 1081 provide the data and information to the controller 1049 for displaying the real-time stock quotes or other indicia

1038. Additionally, or alternatively, the controller 1049 may be adapted to allow various user inputs. In one embodiment, the controller 1049 is programmable by a laptop computer to allow a user to input the particular indicia 1038 that will be displayed by the display device 1080.

In another form, the present invention provides a method that in one embodiment generally comprises: transmitting a signal to at least one lighted headwear piece from a source external to the lighted headwear piece; receiving the signal (e.g., wirelessly) at the lighted headwear piece; and controlling the operation of at least one light source coupled to the lighted headwear piece in accordance with the signal.

In at least one embodiment, the method further includes transmitting the signal to a plurality of lighted headwear pieces each of which includes at least one light source; and controlling the operation of the light sources in accordance with the signal. The operation of the light sources of the lighted headwear pieces can be synchronized in accordance with the signal to provide a stimulating and pleasing visual effects. For example, fans at a sporting event can wear lighted hats that include light sources which, in response to the signal, emit synchronized flashing light in colors consistent with the home team's colors. Or for example, the signal may cause the light sources to produce a lighted wave-like effect through the stadium stands.

It is anticipated that embodiments of the invention will be applicable to any of a wide range of headwear pieces of various types, shapes, sizes, colors, etc. including baseball caps, visors, visor attachments to existing headwear pieces, bicycle helmets, cowboy hats, among others. Accordingly, the specific references to hat or headwear piece herein should not be construed as limiting the scope of the present invention to only one specific form/type of headwear piece or hat.

The description of the invention is merely exemplary in nature and is in no way intended to limit the invention, its application, or uses. Thus, variations that do not depart from the substance of the invention are intended to be within the scope of the invention. Such variations are not to be regarded as a departure from the spirit and scope of the invention.

What is claimed is:

1. A lighted headwear piece comprising:

a head attachment portion;

a bill extending from the head attachment portion, the bill including at least a portion responsive to black light; and at least one black-light light source that is substantially enclosed within the bill such that black light is transmissible out of the bill through the black light-responsive portion of the bill.

2. The lighted headwear piece of claim 1, wherein the light source comprises a black light LED.

3. The lighted headwear piece of claim 1, wherein the black light-responsive portion is disposed at least partially within the bill.

4. The lighted headwear piece of claim 3, wherein the head attachment portion further comprises at least a portion responsive to black light and at least one light source substantially enclosed within the head attachment portion for emitting black light that is only transmissible through the black light-responsive portion of the head attachment portion.

5. A lighted headwear piece comprising:

a head attachment portion;

a bill extending from the head attachment portion, the bill includes a portion responsive to black light; and at least one black light LED substantially enclosed within the bill for directing black light at the black light-responsive portion.

6. A lighted headwear piece comprising:

a head attachment portion;

a bill extending from the head attachment portion;

at least one light source positioned for directing light through a portion of the bill; and a flexible tubular member coupled to an edge portion of the bill, the flexible tubular member including a light-transmissive portion, and wherein the light source is coupled to the flexible tubular member for directing light through the light-transmissive portion of the flexible tubular member.

7. The lighted headwear piece of claim 6, wherein the flexible tubular member has a substantially circular transverse cross section.

8. An apparatus for illuminating an edge portion of a bill of a headwear piece, the apparatus comprising:

a flexible tubular member adapted to be positioned along the edge portion of the bill, the flexible tubular member including a light-transmissive portion; and at least one light source coupled to the flexible tubular member for directing light through the light-transmissive portion, wherein the flexible tubular member includes a longitudinal slit sized to frictionally receive therein the edge portion of the bill.

9. The apparatus of claim 8, wherein the flexible tubular member has a substantially circular transverse cross section.

10. A headwear piece comprising a bill and an apparatus positioned along an edge portion of the bill for illuminating an edge portion of a bill of a headwear piece, the apparatus comprising:

a flexible tubular member adapted to be positioned along the edge portion of the bill, the flexible tubular member including a light-transmissive portion; and at least one light source coupled to the flexible tubular member for directing light through the light-transmissive portion.

11. The headwear piece of claim 10, wherein the flexible tubular member has a substantially circular transverse cross section.

* * * * *